US006686705B2

(12) United States Patent
Nerone et al.

(10) Patent No.: US 6,686,705 B2
(45) Date of Patent: Feb. 3, 2004

(54) BALLAST CIRCUIT WITH MULTIPLE INVERTERS AND DIMMING CONTROLLER

(75) Inventors: Louis R. Nerone, Brecksville, OH (US); David J. Kachmarik, Strongsville, OH (US); Melvin C. Cosby, Grand River, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,620

(22) Filed: Jan. 25, 2002

(65) Prior Publication Data

US 2003/0141830 A1 Jul. 31, 2003

(51) Int. Cl.[7] ..... G05F 1/00
(52) U.S. Cl. ..... 315/291
(58) Field of Search ..... 315/209 R, 224, 315/225, 291, 307, DIG. 5

(56) References Cited

U.S. PATENT DOCUMENTS 5,838,116 A * 11/1998 Katyl et al. ..... 315/307
6,137,233 A * 10/2000 Moisin ..... 315/209 R
6,137,239 A * 10/2000 Wu et al. ..... 315/291
6,160,358 A * 12/2000 Moisin ..... 315/291
6,177,769 B1 * 1/2001 Bezdon et al. ..... 315/291
6,181,066 B1 * 1/2001 Adamson ..... 315/282
6,218,788 B1 4/2001 Chen et al. ..... 315/225
6,320,329 B1 * 11/2001 Wacyk ..... 315/291
6,437,520 B1 * 8/2002 Grouev et al. ..... 315/291

* cited by examiner

*Primary Examiner*—Don Wong
*Assistant Examiner*—Minh D A
(74) *Attorney, Agent, or Firm*—Fay, Sharpe, Fagan, Minnich & McKee, LLP

(57) ABSTRACT

A ballast circuit is provided, comprising: a plurality of inverters, each inverter for powering a load; and a controller operationally coupled to a shutdown control signal of each inverter for selectively shutting down any combination of inverters. In another aspect, the controller is for selectively disabling any combination of inverters to effectively disconnect the load associated with each disabled inverter. The controller is for receiving communications from a control device, each communication a selection of 0%, "n−1" approximate percentages each associated with a ratio of "1" through "n−1" loads to "n" loads, where "n" is the total number of loads powered by the inverters of the ballast circuit and where the numerator for each ratio is an integer between "1" and "n−1," inclusive, or 100% light from the combined loads powered by the inverters of the ballast circuit.

14 Claims, 2 Drawing Sheets

BALLAST CIRCUIT WITH MULTIPLE INVERTERS AND DIMMING CONTROLLER

BACKGROUND OF INVENTION

The present invention relates generally to a ballast circuit for gas discharge lamps. More particularly, this invention relates to a ballast circuit with multiple inverters and a dimming controller for individually controlling each inverter.

Either regulating the lamp current or regulating the average current feeding an inverter are techniques for dimming fluorescent lamps with class D converters. For cold cathode fluorescent lamps (CCFLs), the pulse width modulating (PWM) technique is commonly used to expand a dimming range. The technique pulses the CCFLs at full rated lamp current thereby modulating intensity by varying the percentage of time the lamp is operating at full-rated current. Such a system can operate with a closed loop or an open loop system. The technique is simple, low cost, and a fixed frequency operation, however, it is not easily adapted to hot cathode fluorescent lamps. For proper dimming of hot cathode lamps, the cathode heating needs to be increased, as light intensity is reduced. If inadequate heating exists, cathode sputtering increases as the lamp is dimmed. Also, the lamp arc crest factor should be less than 1.7 for most dimming ranges, in order to maintain the rated lamp life. The higher the crest factor, the shorter will be the life of the lamp. The PWM method does not address these problems, and therefore so far has been limited to CCFL applications.

Class D inverter topology with variable frequency dimming has been widely accepted by lighting industry for use as preheat, ignition and dimming of a lamp. The benefits of such a topology include, but is not limited to (i) ease of implementing programmable starting sequences which extend lamp life; (ii) simplification of lamp network design; (iii) low cost to increase lamp cathode heating as the lamp is dimmed; (iv) obtainable low lamp arc crest factor; (v) ease of regulating the lamp power by either regulating the lamp current or the average current feeding the inverter; and (vi) zero voltage switching can be maintained by operating the switching frequency above the resonant frequency of the inverter.

Conventional class D circuits which are used for d.c.-to-d.c. converters or electronic ballasts, implement a two-pole active switch via two, n-channel devices or n-p-channel complementary pairs. A gate is voltage controllable from a control-integrated circuit (IC), which is normally referenced to ground, thus, the control signals have to be level shifted to the source of the high-side power device, which, in class D applications, swings between two rails of the circuit. The techniques presently used to perform this function are by either, transformer coupling or a high-voltage integrated circuit (HVIC) with a boot-strapped, high side driver. Either solution imposes a severe cost and performance penalty.

For transformer coupling, the transformer needs to have at least three isolated windings wound on a single core, adding to cost and space considerations. The windings need to be properly isolated to prevent breakdown due to the presence of high potential. Also, the gate's drive circuit needs to be damped and clamped to prevent ringing between leakage inductors of the transformer and parasitic capacitors of switching MOSFETs.

In the case of high-voltage integrated circuits (HVIC), the HVIC has two isolated output buffers and logic circuitry which is sensitive to negative transients. The high-voltage process for the IC increases the size of the silicon die, and the boot-strap components add to the part count and costs. Such a system is also severely limited as to the switching frequency obtainable, which commonly is less than 100 KHz. Consequently, it uses the large sizes of EMI filters and resonant components aid requires larger space for implementation.

As described above, many types of dimming ballast circuits have been proposed that control the arc current of a fluorescent lamp. An external means of heating the cathode prevents sputtering of the cathodes whenever the arc current is reduced to less than 50% of its rated value. However, the efficiency of such dimming circuits falls off as the light intensity is reduced with the implementation of external cathode heating.

Multiple-ballast fluorescent lamp fixtures control lamps either in pairs or individually. For example, a three-lamp fixture may have a two-lamp ballast and a one-lamp ballast whereby the light intensity can be changed from 33% to 100% of its rated value by turning on a specific ballast. This requires at least two ballasts to cover a 3 to 1 range in brightness, which may increase cost and impact the available space in the fixture.

It is desirable to have a single ballast circuit for a multiple-lamp gas discharge fixture, wherein the ballast circuit is capable of powering a plurality of lamps from an efficiency perspective and from a packaging and cost perspective. Therefore, it is desirable for such a ballast circuit to be able to dim the light fixture by turning off individual lamps, leaving various combinations of lamps lit.

SUMMARY OF INVENTION

In one embodiment of the present invention, a ballast circuit comprises a plurality of inverters, each inverter configured for powering a load; and a controller operationally coupled to a shutdown control signal of each inverter for selectively shutting down any combination of inverters.

In another aspect of the invention, a dimming ballast is provided. The dimming ballast circuit comprises, a plurality of inverters, each inverter for powering a load; a controller operationally coupled to a shutdown control signal of each inverter for selectively disabling any combination of inverters to effectively disconnect the load associated with each disabled inverter.

DETAILED DESCRIPTION

Figure 1:
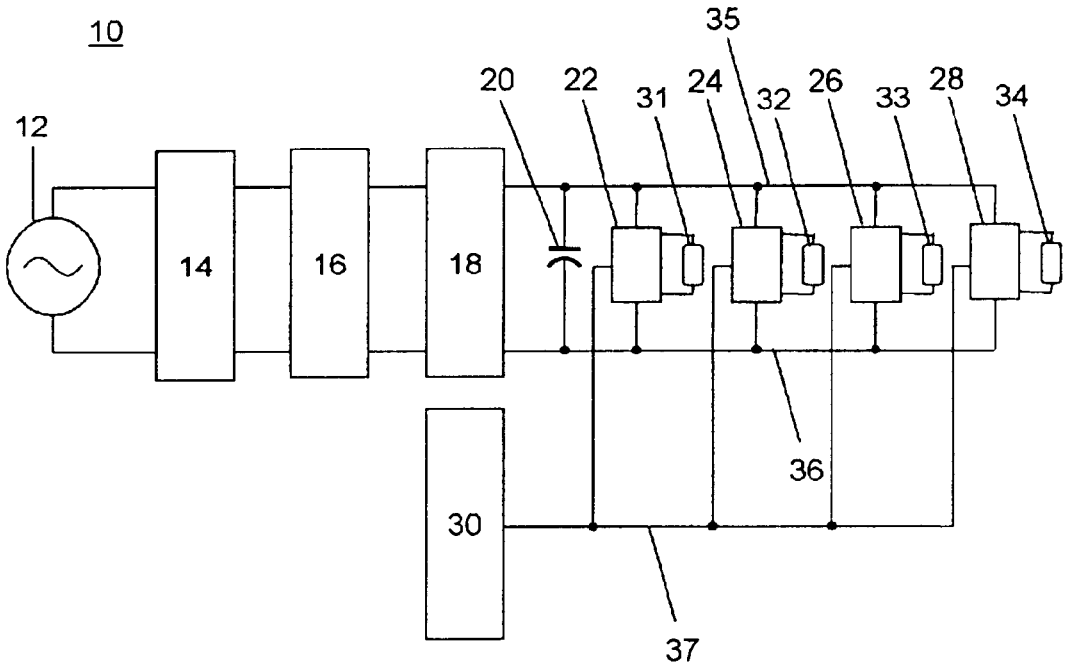
FIG. 1 is a block diagram of a ballast circuit in accordance with the present invention.

FIG. 1 shows a ballast circuit 10 in accordance with the present invention. The ballast circuit 10 is comprised of an a.c. power source 12, an electromagnetic interference (EMI) filter 14, a bridge rectifier 16, a power factor correction circuit 18, a bus capacitor 20, four inverters 22, 24, 26, 28, and a controller 30. While four inverters are shown in this embodiment, other combinations of inverters are contemplated (e.g., two inverters or three inverters). Each inverter is coupled to a load 31, 32, 33, 34. The a.c. power source 12 is filtered by the EMI filter 14 and rectified by the bridge rectifier 16. The bridge rectifier supplies d.c. voltage to the power factor correction circuit 18. The power factor correction circuit 18, also referred to as a boost converter, supplies a d.c. bus 35 and a return line 36 to the bus capacitor 20 and each of the inverters 22, 24, 26, 28.

Each inverter 22, 24, 26, 28 may be turned on or off by the controller 30 via the shutdown control signal 37. In other words, each inverter 22, 24, 26, 28 is individually addressable and controllable by the controller 30. This may be accomplished by discrete shutdown control signals for each inverter or through coding/decoding of a shutdown control signal daisy chain or bus. This allows for the operation of zero to inverters, where "n" is the number of inverters coupled to the d.c. bus 35 and common return line 36 (i.e., four inverters 22, 24, 26, 28 in the embodiment shown). For example, where the load on each of four inverters is a gas discharge lamp capable of emitting approximately equivalent light, the ballast circuit 10 is capable of dimming the lighting provided by the lamp fixture to about 75%, about 50%, and about 25% by shutting down one inverter (e.g., 22), two inverters (e.g., 22, 24), or three inverters (e.g., 22, 24, 26). In addition, the controller can permit 100% lighting by not shutting down any of the inverters or can extinguish the fixture by shutting down all of the inverters (22, 24, 26, 28).

A feature of the invention includes packaging the components of the ballast circuit 10, excluding the a.c. power source 12 and loads 31, 32, 33, 34, in a single enclosure. The enclosure is adaptable to mounting within a gas discharge lamp fixture. The enclosure may be hermetically sealed and/or potted. A number of additional packaging methods for the components of the ballast circuit 10 are envisioned and will be recognized by those skilled in the art upon reading the description of the invention.

Figure 2:
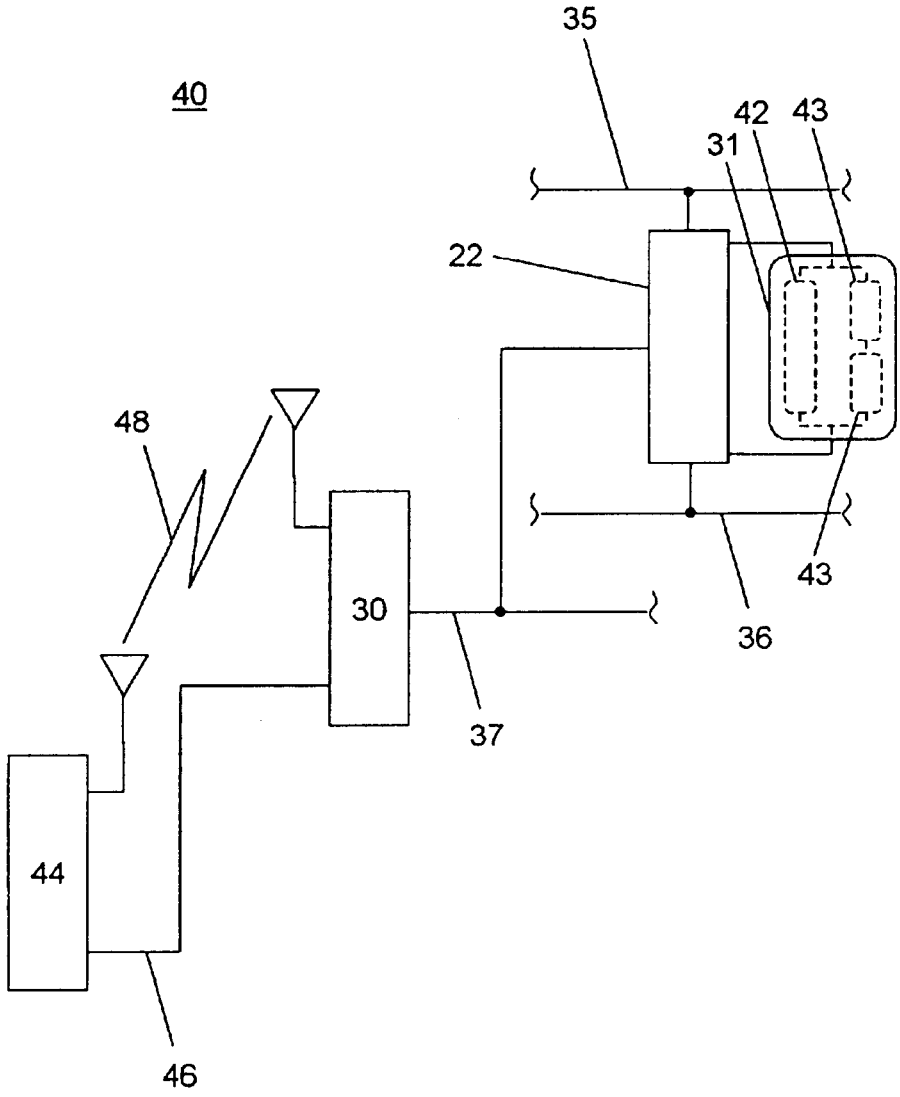
FIG. 2 is a block diagram showing a portion of the ballast circuit of FIG. 1 interfacing with an external control device and a load

FIG. 2 shows circuit 40 including a portion of the ballast circuit 10 of FIG. 1 and an external control device. More specifically, the circuit 40 is comprised of inverter 22, controller 30, load 31, and control device 44. The load 31 may be comprised of, for example, one or more gas discharge lamps. Where the load is comprised of two or more gas discharge lamps, the lamps can be arranged in a serial or parallel combination. A single gas discharge lamp 42 and two serially-connected gas discharge lamps 43 are shown as two alternative configurations of the load 31 in FIG. 2. This is an example of how each inverter 22, 24, 26, 28 of the ballast circuit 10 in FIG. 1 provides power to a load. The control device 44 can range from a simple single pole switch to a communications transceiver. As shown, signals between the control device 44 and the controller 30 can be transmitted using either wire lines 46 or a wireless link 48. The wire lines 46 or wireless link 48 can be implemented individually or in combination. The wire lines 46 are preferably the power lines, however, serial control lines, parallel control lines, and discrete control lines are also envisioned. Where the power line is implemented, the control device 44 and controller 30 must have compatible transceivers that can satisfactorily send and receive the appropriate control data (e.g. light "on," 75% light, 50% light, 25% light, or light "off") over the power line. Where serial or parallel control lines are implemented, the control device 44 and controller 30 must have compatible coding and decoding components to send and receive the appropriate control data. Where discrete control lines are implemented, the control device 44 and controller 30 must have compatible input and output components to ensure the appropriate command is interpreted and the appropriate control sequence is initiated. One of the simplest forms of communication may simply convey activation of a single pole switch at the control device using two discreet control lines. The controller may interpret such activation as a command to advance from the current lighting condition to the next condition based on a revolving sequence of light "on," 75% light, 50% light, 25% light, and light "off." Many more complex forms of serial, parallel, and discrete control schemes will be envisioned by those skilled in the art upon reading this specification.

The wireless link 48 can be implemented through radio frequency, infrared, or other types of wireless technology. Where the wireless link 48 is implemented the control device 44 and controller 30 must have compatible transceivers or a transmitter (control device)/receiver (controller) combination that can satisfactorily send and receive the appropriate control data.

The controller 30 may have discrete set-points associated with each control data command and may default to a predetermined set-point upon the re-cycling of the power line voltage.

In more general terms, the control scheme implemented by the controller 30 is capable of selecting any one of "n+1" increments from 0% to 100% of light emission. The controller 30 receives communications from the control device 44, each communication represents a selection of 0%, "n−1" approximate percentages each associated with a ratio of "1" through "n−1" loads to "n" loads, where "n" is the total number of loads powered by the inverters of the ballast circuit and where the numerator for each ratio is an integer between "1" and "n−1," inclusive, or 100% light from the combined loads powered by the inverters of the ballast circuit. The controller 30 disables all of the inverters for the selection of 0% light. The controller disables any "1" through "n−1" inverters for the selection of a corresponding approximate percentage associated with a ratio of "1" through "n−1" loads to "n" loads. The controller disables none of the inverters for the selection of 100% light. This control scheme presumes that each of a plurality of loads powered by the inverters of the ballast circuit emits about equal light. If the loads do not emit equal light, the control scheme works in the same fashion, but the percentages would be based on the actual light emitted by each load, rather than being proportional to the total number of loads.

Where the ballast circuit is comprised of two inverters, the control scheme is capable of selecting any one of three increments (i.e., 0%, about 50%, and 100%) of light emission. The controller 30 receives communications from the control device 44, each communication represents a selection of 0%, about 50%, or 100% light from the combined loads powered by the inverters of the ballast circuit. The controller 30 disables all of the inverters for the selection of 0% light. The controller disables any one of the inverters for the selection of about 50% light. The controller disables none of the inverters for the selection of 100% light.

Where the ballast circuit is comprised of three inverters, the control scheme is capable of selecting any one of four increments (i.e., 0%, about 33%, about 66%, and 100%) of light emission. The controller 30 receives communications from the control device 44, each communication represents a selection of 0%, about 33%, about 66%, or 100% light from the combined loads powered by the inverters of the ballast circuit. The controller 30 disables all of the inverters for the selection of 0% light. The controller disables any two of the inverters for the selection of about 33% light. The controller disables any one of the inverters for the selection of about 66% light. The controller disables none of the inverters for the selection of 100% light.

Where the ballast circuit is comprised of four inverters, the control scheme is capable of selecting any one of five increments (i.e., 0%, about 25%, about 50%, about 75%, and 100%) of light emission. The controller 30 receives communications from the control device 44, each communication represents a selection of 0%, about 25%, about 50%, about 75%, or 100% light from the combined loads powered by the inverters of the ballast circuit. The controller 30 disables all of the inverters for the selection of 0% light. The controller disables any three for the inverters for the selection of about 25% light. The controller disables any two of the inverters for the selection of about 50% light. The controller disables any one of the inverters for the selection of about 75% light. The controller disables none of the inverters for the selection of 100% light.

It is to be appreciated that at locations within the specification referring to specific valves, that these valves are also intended to include ranges which would reasonably be accepted in the industry.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit, comprising:

a plurality of inverters adapted to receive power from a single AC power source, each inverter for selectively powering a load;

a controller operationally coupled to each inverter via a shutdown control signal for selectively shutting down any combination of inverters to accomplish dimming without feedback signals from the inverters or associated; and, an external control device adapted to transmit communications to the controller, the communications including a selection of one or more inverters for shutdown, wherein the controller responds to the communications by shutting down the selected inverters using the shutdown control signal.

2. The ballast circuit of claim 1, wherein each load is one of the group consisting of a single gas discharge lamp, two serially-connected gas discharge lamps, and two parallel-connected gas discharge lamps.

3. The ballast circuit of claim 1, wherein the controller receives communications from the external control device via wire lines, wherein the wire lines are one of the group consisting of power lines, serial control lines, parallel control lines, and discrete control lines.

4. The ballast circuit of claim 1, wherein the controller receives communications from the external control device via a wireless link, wherein the wireless link is one of the group consisting of a radio frequency link and an infrared frequency link.

5. The ballast circuit of claim 1, further comprising:

an electromagnetic interference (EMI) filter;

a bridge rectifier;

a power factor correction circuit; and a bus capacitor.

6. The ballast circuit of claim 5, wherein the plurality of inverters, the controller, the EMI filter, the bridge rectifier, the power factor correction circuit, and the bus capacitor are packaged in a common enclosure adaptable for mounting in a gas discharge lamp fixture.

7. The ballast circuit of claim 1, the plurality of inverters further comprising:

a first inverter for selectively powering a first load; and a second inverter for selectively powering a second load.

8. The ballast circuit of claim 7, wherein the communications received by the controller from the external control device include a selection of 0%, about 50%, and 100% light from the combined loads powered by the inverters of the ballast circuit, and wherein the controller shuts down any one of the inverters via the shutdown control signal for the selection of about 50% light.

9. A dimming ballast circuit, comprising:

an enclosure, further comprising:

a plurality of inverters disposed within the enclosure and adapted to receive power from a single AC power source, each inverter for selectively powering a load; and a controller disposed within the enclosure and operationally coupled to a shutdown control signal of each inverter for selectively disabling any combination of inverters to effectively disconnect the load associated with each disabled inverter; and a control device external to the enclosure and operationally coupled to the controller;

wherein the controller receives communications from the control device, each communication representing a selection of (i) 0%, (ii) "n−1" approximate percentages each associated with a ratio of "1" through "n−1" loads to "n" loads, where "n" is the total number of loads powered by the inverters of the ballast circuit and where the numerator for each ratio is an integer between "1" and "n−1" inclusive, or (iii) 100% light from the combined loads powered by the inverters of the ballast circuit.

10. The dimming ballast circuit of claim 9 wherein the controller disables all of the inverters for the selection of 0% light, wherein the controller disables none of the inverters for the selection of 100% light.

11. The dimming ballast circuit of claim 9, wherein the controller disables any "1" through "n−1" inverters for the selection of a corresponding approximate percentage of light associated with a ratio of "1" though "n−1" loads to "n" loads.

12. A dimming ballast circuit, comprising:

a first inverter adapted to receive power from a single AC power source for selectively powering a first load;

a second inverter adapted to receive power from the single AC power source for selectively powering a second load; and a controller operationally coupled to a shutdown control signal of each inverter for selectively disabling any combination of inverters to effectively disconnect the load associated with each disabled inverter;

wherein the controller is adapted to receive communications from an external control device, the communications including a selection of 0%, about 50%, and 100% light from the combined loads powered by the inverters of the ballast circuit, and wherein the controller disables any one of the inverters for the selection of about 50% light.

13. The dimming ballast circuit of claim 12, further comprising:

a third inverter adapted to receive power from the single AC power source for selectively powering a third load;

wherein the communications received by the controller from the external control device include a selection of 0%, about 33%, about 66%, and 100% light from the combined loads powered by the inverters of the ballast circuit, wherein the controller disables any two of the inverters for the selection of about 33% light, and wherein the controller disables any one of the inverters for the selection of about 66% light.

14. The dimming ballast circuit of claim 13, further comprising:

a fourth inverter adapted to receive power from the single AC power source for selectively powering a fourth load;

wherein the communications received by the controller from the external control device include a selection of 0%, about 25%, about 50%, about 75%, and 100% light from the combined loads powered by the inverters of the ballast circuit, wherein the controller disables any three of the inverters for the selection of about 25% light, wherein the controller disables any two of the inverters for the selection of about 50% light, and wherein the controller disables any one of the inverters for the selection of about 75% light.

* * * * *